US006453137B2

(12) United States Patent
Iinuma

(10) Patent No.: US 6,453,137 B2
(45) Date of Patent: Sep. 17, 2002

(54) IMAGE FORMING APPARATUS WITH GROOVED PHOTOSENSITIVE DRUM

(75) Inventor: Kiyoshi Iinuma, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/861,585

(22) Filed: May 22, 2001

(30) Foreign Application Priority Data

May 25, 2000 (JP) ..... 2000-155177

(51) Int. Cl.[7] ..... G03G 15/00
(52) U.S. Cl. ..... 399/159; 399/116
(58) Field of Search ..... 399/116, 159, 399/167, 162, 356; 430/56, 66, 67

(56) References Cited

U.S. PATENT DOCUMENTS 5,027,161 A * 6/1991 Kume et al. ..... 399/356
5,068,762 A * 11/1991 Yoshihara ..... 399/159
5,162,856 A * 11/1992 Hayashida et al. ..... 399/159
5,242,776 A * 9/1993 Doi et al. ..... 399/159

* cited by examiner

*Primary Examiner*—Hoang Ngo
(74) *Attorney, Agent, or Firm*—Fitzpatrick, Cella, Harper & Scinto

(57) ABSTRACT

An electrophotographic image forming apparatus including a photosensitive drum and an image exposure unit for drawing an electrostatic latent image on a surface of the photosensitive drum. A developing unit develops the electrostatic latent image on the surface of the photosensitive drum by means of developer and a transfer charger transfers the developed image onto a receiving material. A cleaning unit removes developer remaining on the surface of the photosensitive drum after the transfer. The photosensitive drum is driven to rotate so as to make a cycle of image forming operation proceed. The photosensitive drum includes a base member on a surface of which a plurality of line grooves having a triangular cross section are formed and arranged around the circumference in parallel with each other at a pitch of 17 to 19 $\mu$m. The photosensitive drum also has a photosensitive layer of amorphous silicon with an arithmetical mean deviation of the profile of Ra=0.08 to 0.12 $\mu$m.

5 Claims, 3 Drawing Sheets

IMAGE FORMING APPARATUS WITH GROOVED PHOTOSENSITIVE DRUM

BACKGROUND OF THE INVENTION

1. Field of the Invention

This invention relates to an electrophotographic image forming apparatus to be suitably utilized as image forming means such as a copying machine, a printer or a facsimile machine and also to an electrophotographic image forming method for using such an apparatus.

2. Related Background Art

Electrophotographic image forming apparatus to be utilized as copying machines and printers comprising a highly durable so-called amorphous silicon photosensitive drum having a photoconductive layer (photosensitive layer) of amorphous silicon (non-single-crystal based on Si atoms, preferably noncrystalline silicon) are popularly known. Particularly, some known electrophotographic image forming apparatus that can print images at a rate of 45 sheets or more per minute comprise an amorphous silicon photosensitive drum and have a configuration as described below.

Such high speed electrophotographic image forming apparatus generally comprise an amorphous silicon photosensitive drum, a primary charger, an image exposure unit, a developing unit, a transfer charger, a separation charger and a cleaning unit. The primary charger electrically uniformly charges the amorphous silicon photosensitive drum. The image exposure unit irradiates the electrically uniformly charged amorphous silicon photosensitive drum with a laser beam in order to draw an electrostatic latent image on the surface thereof. The developing unit develops the electrostatic latent image on the surface of the amorphous silicon photosensitive drum by means of developer. The transfer charger transfers the image developed by means of developer from the amorphous silicon photosensitive drum to a receiving material. The separation charger separates the receiving material from the amorphous silicon photosensitive drum. The cleaning unit removes the developer remaining on the surface of the amorphous silicon photosensitive drum after the transfer and comprises a cleaning blade and a magnetic roller operating as auxiliary cleaning member.

The amorphous silicon photosensitive drum is prepared by forming an about 30 $\mu$m thick amorphous silicon photosensitive layer by means of CVD (chemical vapor phase growth) or PVD (physical vapor deposition) on the surface of a base member that is a cylindrical body of aluminum having a mirror-finished surface or a surface provided with a plurality of line grooves having a triangular cross section and arranged around the circumference in parallel with each other. If the surface is provided with a plurality of line grooves having a triangular cross section and arranged around the circumference in parallel with each other, they are arranged at a pitch of about 80 $\mu$m and the surface approximately shows a ten-point height of irregularities of Rz=2.4 to 4.0 $\mu$m.

However, it is known that, in the case of image forming apparatus comprising an amorphous silicon photosensitive drum of an aluminum base member having a mirror-finished surface, the rotation starting torque of the amorphous silicon photosensitive drum rises in the course of long use so that molten toner can easily adhere to the drum surface or a scraped drum can occur.

On the other hand, in the case of image forming apparatus comprising an amorphous silicon photosensitive drum of an aluminum base member having a surface provided with a plurality of line grooves having a triangular cross section and arranged around the circumference in parallel with each other, the laser beam striking the photosensitive layer can be reflected by the surface of the aluminum base member to give rise to interference fringes, which by turn can produce blurred and/or distorted images.

SUMMARY OF THE INVENTION

In view of the above identified circumstances, it is therefore an object of the present invention to provide an electrophotographic image forming apparatus that can form high quality images without the problem of uneven and/or distorted images and that of molten toner adhering to the drum surface and a scraped drum and also an electrophotographic image forming method that can be used with such an electrophotographic image forming apparatus.

It is another object of the present invention to provide an electrophotographic image forming apparatus that can suppress the rotation starting torque of the photosensitive drum and consequently make itself free from the problem of unevenly drawn images, molten toners adhering to the drum surface and a scraped drum after a long use so as to improve the image quality and the durability and also an electrophotographic image forming method that can be used with such an electrophotographic image forming apparatus.

It is a further object of the present invention to provide an electrophotographic image forming apparatus for which a cleaning means including a cleaning blade and a cleaning auxiliary member of a magnet roller for supplying toner to the photosensitive drum is used in order to further improve the durability of the apparatus and also an electrophotographic image forming method that can be used with such an electrophotographic image forming apparatus.

In a first aspect of the invention, the above objects are achieved by providing an electrophotographic image forming apparatus comprising:

a photosensitive drum;

an exposure means for drawing an electrostatic latent image on the surface of the photosensitive drum;

a developing means for developing the electrostatic latent image on the surface of the photosensitive drum by means of developer;

a transfer means for transferring the image developed by means of developer onto a receiving material; and a cleaning means for removing the developer remaining on the surface of the photosensitive drum after the transfer;

the photosensitive drum being driven to rotate so as to make a cycle of image forming operation proceed;

the photosensitive drum having a photosensitive layer of amorphous silicon with an arithmetical mean deviation of the profile of Ra=0.08 to 0.12 $\mu$m.

In a second aspect of the invention, there is provided an electrophotographic image forming apparatus comprising:

a photosensitive drum;

an exposure means for drawing an electrostatic latent image on the surface of the photosensitive drum;

a developing means for developing the electrostatic latent image on the surface of the photosensitive drum by means of developer;

a transfer means for transferring the image developed by means of developer onto a receiving material; and a cleaning means for removing the developer remaining on the surface of the photosensitive drum after the transfer;

the photosensitive drum being driven to rotate so as to make a cycle of image forming operation proceed;

the photosensitive drum being driven with a rotation starting torque not greater than 0.39 N·m.

In a third aspect of the invention, there is provided an electrophotographic image forming method for conducting a cycle of image forming operation by using an electrophotographic image forming apparatus comprising:

a photosensitive drum;

an exposure means for drawing an electrostatic latent image on the surface of the photosensitive drum;

a developing means for developing the electrostatic latent image on the surface of the photosensitive drum by means of developer;

a transfer means for transferring the image developed by means of developer onto a receiving material; and a cleaning means for removing the developer remaining on the surface of the photosensitive drum after the transfer;

the photosensitive drum being driven to rotate with a rotation starting torque not greater than 0.39 N·m so as to make the cycle of image forming operation proceed.

DESCRIPTION OF THE PREFERRED EMBODIMENTS

Figure 1:
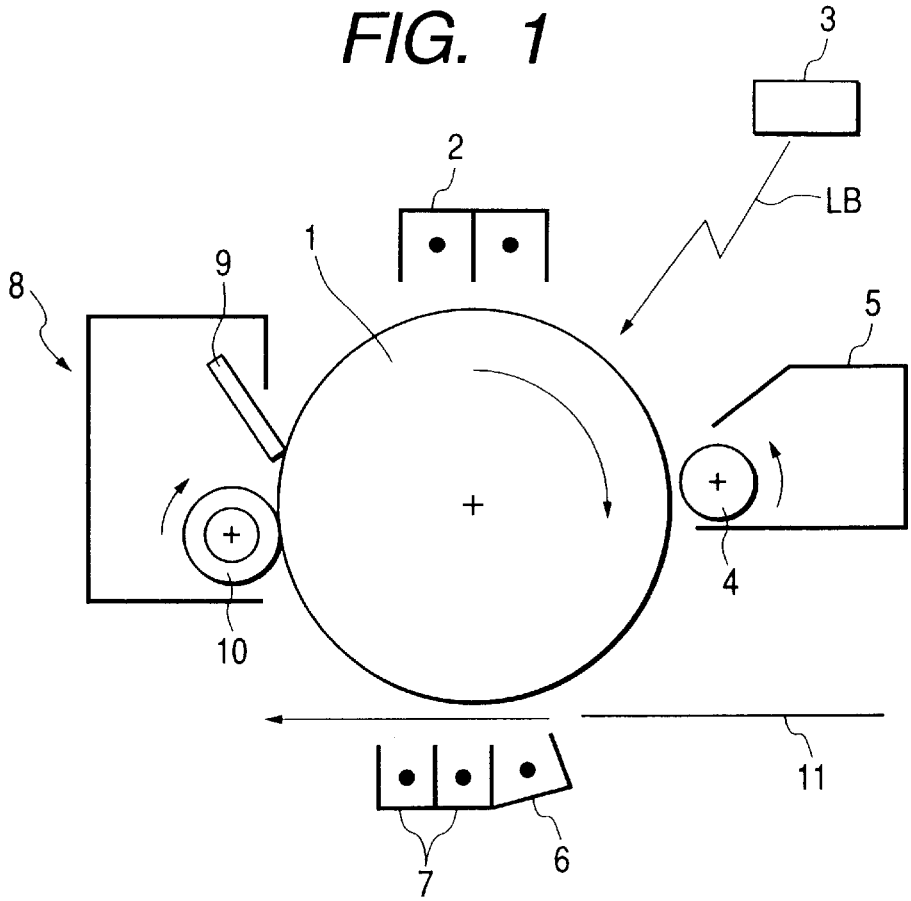
FIG. 1 is a schematic cross sectional view of an embodiment of electrophotographic image forming apparatus according to the invention.

The present invention is based on the finding that the above identified problems can be solved and the above objects of the invention can be achieved by providing the photosensitive drum with an appropriate surface condition.

On the basis of the above finding, according to the invention, there is provided an electrophotographic image forming apparatus comprising:

a photosensitive drum;

an exposure means for drawing an electrostatic latent image on the surface of the photosensitive drum;

a developing means for developing the electrostatic latent image on the surface of the photosensitive drum by means of developer;

a transfer means for transferring the image developed by means of developer onto a receiving material; and a cleaning means for removing the developer remaining on the surface of the photosensitive drum after the transfer;

the photosensitive drum being driven to rotate so as to make a cycle of image forming operation proceed;

the photosensitive drum having a photosensitive layer of amorphous silicon with an arithmetical mean deviation of the profile of Ra=0.08 to 0.12 $\mu$m.

Preferably, in such an image forming apparatus, the surface of the photosensitive drum has a ten-point height of irregularities of Rz=0.45 to 0.75 $\mu$m.

Preferably, a plurality of line grooves having a triangular cross section are formed on the surface of the base member of the photosensitive drum and arranged around the circumference in parallel with each other at a pitch of 17 to 19 $\mu$m.

Preferably, the cleaning means includes a cleaning blade and a cleaning auxiliary member. Preferably, the cleaning auxiliary member is a magnet roller for supplying developer to the photosensitive drum and located upstream relative to the cleaning blade.

With the above arrangement, the rotation starting torque of the photosensitive drum can be held lower than a predetermined value such as 0.39 N·m after long use. As a result, the produced images are free from unevenness and no molten developer would adhere to the photosensitive drum so that the drum can be prevented from being scraped to allow the electrophotographic image forming apparatus to durably produce high quality images.

According to the invention, there is also provided an electrophotographic image forming apparatus comprising:

a photosensitive drum;

an exposure means for drawing an electrostatic latent image on the surface of the photosensitive drum;

a developing means for developing the electrostatic latent image on the surface of the photosensitive drum by means of developer;

a transfer means for transferring the image developed by means of developer onto a receiving material; and a cleaning means for removing the developer remaining on the surface of the photosensitive drum after the transfer;

the photosensitive drum being driven to rotate so as to make a cycle of image forming operation proceed;

the photosensitive drum being driven with a rotation starting torque not greater than 0.39 N·m.

According to the invention, there is also provided an electrophotographic image forming method for conducting a cycle of image forming operation by using an electrophotographic image forming apparatus comprising:

a photosensitive drum;

an exposure means for drawing an electrostatic latent image on the surface of said photosensitive drum;

a developing means for developing the electrostatic latent image on the surface of the photosensitive drum by means of developer;

a transfer means for transferring the image developed by means of developer onto a receiving material; and a cleaning means for removing the developer remaining on the surface of the photosensitive drum after the transfer;

the photosensitive drum being driven to rotate with a rotation starting torque not greater than 0.39 N·m so as to make the cycle of image forming operation proceed.

Now, the present invention will be described by referring to the accompanying drawings.

EXAMPLE 1

FIG. 1 is a schematic cross sectional view of an embodiment of electrophotographic image forming apparatus according to the invention that was used in Example 1. The electrophotographic image forming apparatus comprises an amorphous silicon photosensitive drum 1, a primary charger 2, an image exposure unit (exposure means) 3, a developing unit (developing means) 5, a transfer charger (transfer means) 6, a separation charger 7 and a cleaning unit (cleaning means) 8.

The primary charger 2 electrically uniformly and positively charges the surface of the amorphous silicon photosensitive drum 1 by means of a DC corona discharge.

The image exposure unit 3 draws an electrostatic latent image on the surface of the uniformly and positively charged amorphous silicon photosensitive drum 1. In this example, the photosensitive drum 3 is irradiated with a laser beam LB having a wavelength of $\lambda$=650 nm.

The developing unit 5 develops the electrostatic latent image on the surface of the amorphous silicon photosensitive drum 1 by jumping development of applying an AC+DC development bias voltage, using a negatively charged one-ingredient magnetic toner (developer).

The transfer charger 6 transfers the image developed by the positive DC corona discharge and the developer from the amorphous silicon photosensitive drum 1 to a receiving material 11.

The separation charger 7 separates the receiving material 11 from the amorphous silicon photosensitive drum 1 by means of an AC corona discharge.

The cleaning unit 8 removes the toner remaining on the surface of the amorphous silicon photosensitive drum 1 after the transfer and comprises a cleaning blade 9 and a magnetic roller 10 operating as auxiliary cleaning member. The cleaning blade 9 is made of urethane type rubber and abuts the amorphous silicon photosensitive drum 1 with a total pressure of 3.9 to 4.9 N. The magnet roller 10 shows a surface magnetic flux density of 80 to 100 mT and is arranged upstream relative to the cleaning blade 9. The magnet roller 10 is so designed as to be able to constantly store waste toner on the surface and is separated from the amorphous silicon photosensitive drum 1 with a longitudinal uniform gap therebetween so that the toner on the surface of the magnet roller 10 may reliably contact the amorphous silicon photosensitive drum 1. The magnet roller 10 is driven to rotate forwardly or reversely from the viewpoint of the rotation of the amorphous silicon photosensitive drum 1 in order to supply the surface of the amorphous silicon photosensitive drum 1 with the toner stored on the surface thereof.

Figure 2:
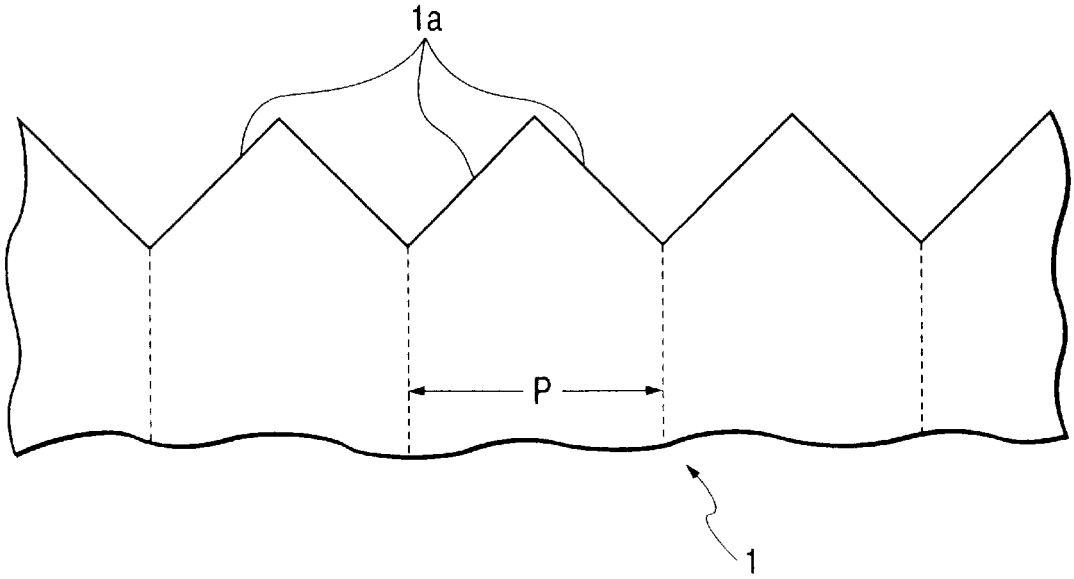
FIG. 2 is an enlarged partial cross sectional view of the base member of the amorphous silicon photosensitive drum of the embodiment of FIG. 1, illustrating the surface profile thereof.

FIG. 2 is an enlarged partial cross sectional view of the amorphous silicon photosensitive drum 1, illustrating the surface profile thereof. The amorphous silicon photosensitive drum 1 is produced by forming a plurality of line grooves 1*a* having a triangular cross section in parallel with each other on the outer peripheral surface of a drum-shaped base member of aluminum and then an about 30 $\mu$m thick amorphous silicon photosensitive film layer thereon by CVD. The surface roughness of the amorphous silicon photosensitive drum 1 is such that its surface shows an arithmetical mean deviation of the profile of Ra=0.08 to 0.10 $\mu$m and a ten-point height of irregularities of Rz=0.45 to 0.60 $\mu$m. The line grooves 1*a* having a triangular cross section formed on the outer peripheral surface of the aluminum base member are arranged at a pitch P of about 17 $\mu$m.

While the photoconductive layer of the amorphous silicon photosensitive drum 1 may be formed as the outermost layer and exposed to air, preferably a surface layer is formed thereon from the viewpoint of prolonging the service life of the photosensitive drum and preventing problems attributable to the environment (such as streamy distortions of images that can be produced in a highly humid atmosphere) from occurring. Preferably, the surface layer is mainly made of noncrystalline silicon carbide or noncrystalline carbon. Additionally, the surface layer preferably contain non-single-crystal silicon. Preferably the non-single-crystal silicon, particularly the noncrystalline silicon, contained in the surface layer by turn contains hydrogen or halogen atoms and may additionally contain atoms of one or more than one elements of Group III of the periodic table such as boron, gallium and indium or of Group V such as phosphor and arsenic.

If hydrogen or halogen atoms (preferably fluorine atoms) are contained in the surface layer, the total content thereof is preferably between 10 atomic % and 40 atomic %.

Preferably, the surface layer also contains hydrogen or halogen atoms. The anti-abrasion properties, the electric characteristics and the environmental stability of the photosensitive drum are further improved when such atoms are contained in the surface layer. If the surface layer is mainly made of noncrystalline silicon carbide (a-SiC) and additionally contains hydrogen atoms, the hydrogen atom content is preferably between 41 and 70 atomic %.

Now, the image forming process of the electrophotographic image forming apparatus will be described below.

The surface of the amorphous silicon photosensitive drum 1 is electrically uniformly charged by means of a DC corona discharge of the primary charger 2 and a laser beam having a wavelength of $\lambda$=650 nm is emitted from the image exposure unit 3 to draw an electrostatic latent image on the surface. More specifically, the blank area or the background of the image is exposed to the laser beam. Subsequently, an AC+DC development bias voltage is applied to the developing sleeve 4 of the developing unit 5 to develop the electrostatic latent image on the surface of the amorphous silicon photosensitive drum 1 by means of negatively charged one-ingredient magnetic negative toner. In this example, strontium titanate is added to the one-ingredient magnetic negative toner by 3.5 wt %.

Then, as the transfer charger 6 is driven for a positive DC corona discharge, the toner adhering to the surface of the amorphous silicon photosensitive drum 1 to produce a desired image is transferred onto the receiving material 11 (recording medium such as recording paper) brought to the right position by a transfer means (not shown). In other words, the image developed by toner is transferred onto the receiving material 11. Thereafter, the receiving material 11 is separated from the amorphous silicon photosensitive drum 1 by means of an AC corona discharge of the separation charger 7. After the receiving material 11 is separated from the amorphous silicon photosensitive drum 1, the toner on the receiving material 11 is fixed by a fixing unit (not shown) and then delivered to the outside of the image forming apparatus by a delivery means (not shown).

After the image developed by toner is transferred to the receiving material 11, the magnet roller 10 is driven to rotate in the sense opposite to the sense of rotation of the amorphous silicon photosensitive drum 1 as it is held in contact with the latter in order to supply the surface of the amorphous silicon photosensitive drum 1 with the toner stored on the surface of the magnet roller 10. Then, the cleaning blade 9 abuts the surface of the amorphous silicon photosensitive drum 1 with a total pressure of 3.9 to 4.9 N to capture the residual toner on the surface of the amorphous silicon photosensitive drum 1. Thus, any toner that is left on the surface of the amorphous silicon photosensitive drum 1 without being transferred onto the receiving material 11, or that was supplied by the magnet roller 10, is scraped off by the cleaning blade 9 and removed from the surface. Since the cleaning blade 10 abuts the surface of the amorphous silicon photosensitive drum 1 after the latter is supplied with toner by the magnet roller 10, only reduced frictional force is generated between the amorphous silicon photosensitive drum 1 and the cleaning blade 10 to consequently make it possible to clean the drum on a stable basis.

In the case of conventional electrophotographic image forming apparatus comprising an amorphous silicon photosensitive drum 1 whose drum-shaped base member is made of aluminum and has a mirror-polished outer peripheral surface, the initial drum rotation starting torque is between 0.20 and 0.29 N·m, which gradually increases in the course of long use, and when the rotation starting torque exceeds 0.39 N·m, it is known that the streamy scars and unevenness can appear on the produced image due to the toner molten and adhering to the drum to scrape the latter.

In view of this finding, in this example, the amorphous silicon photosensitive drum 1 is made to show a surface roughness as expressed in terms of arithmetical mean deviation of the profile of Ra=0.08 to 0.10 μm and ten-point height of irregularities of Rz=0.45 to 0.60 μm and the line grooves 1*a* having a triangular cross section and formed on the outer periphery of the aluminum base member are arranged at a pitch P of 17 μm. A durability test of the image forming apparatus was carried out by producing 3,000,000 copies of the A4 size. After the durability test, the rotation starting torque of the amorphous silicon photosensitive drum 1 remained lower than 0.39 N·m and the image forming apparatus did not produce any image that showed streamy scars and/or unevenness thereon due to molten toner adhering to the drum to scrape the latter. As a result, it was proved that an electrophotographic image forming apparatus according to the invention shows the durability of the level required to ordinary image forming apparatus (and can print 3,000,000 copies). Additionally, as the surface of the amorphous silicon photosensitive drum 1 showed the above described surface roughness and profile, the image forming apparatus did not give rise to any unevenly drawn images attributable to interference fringes of light that can be produced by the exposure to a laser beam. This is because the laser beam that enters the photosensitive layer of the amorphous silicon photosensitive drum is irregularly reflected by the surface of the aluminum base member to suppress the generation of interference fringes.

EXAMPLE 2

The electrophotographic image forming apparatus used in this example has the same configuration as that of Example 1 except the surface roughness and the pitch P of arrangement of line grooves 1*a* having a triangular cross section of the amorphous silicon photosensitive drum 1. The amorphous silicon photosensitive drum 1 of this example is made to show an arithmetical mean deviation of the profile of Ra=0.10 to 0.12 μm and a ten-point height of irregularities of Rz=0.60 to 0.75 μm and the line grooves 1*a* formed on the outer periphery of the aluminum base member are arranged at a pitch P of 19 μm. With the above arrangement, the apparatus showed an improved durability and was free from unevenly drawn images.

EXAMPLE 3

The electrophotographic image forming apparatus used in this example has the same configuration as that of Example 1 in terms of arithmetical mean deviation of the profile of Ra=0.08 to 0.10 μm, ten-point height of irregularities of Rz=0.45 to 0.60 μm and pitch P of arrangement of line grooves 1*a* of about 17 μm. The only difference lies in that the magnet roller 10 of this example is driven to rotate in the sense of rotation of the amorphous silicon photosensitive drum 1. With the above arrangement, the apparatus showed an improved durability and was free from unevenly drawn images.

EXAMPLE 4

The electrophotographic image forming apparatus used in this example has the same configuration as that of Example 2 in terms of arithmetical mean deviation of the profile of Ra=0.10 to 0.12 μm, ten-point height of irregularities of Rz=0.60 to 0.75 μm and pitch P of arrangement of line grooves 1*a* of about 19 μm. The only difference lies in that the magnet roller 10 of this example is driven to rotate in the sense of rotation of the amorphous silicon photosensitive drum 1. With the above arrangement, the apparatus showed an improved durability and was free from unevenly drawn images.

Comparative Example 1

The electrophotographic image forming apparatus used in this comparative example has substantially the same configuration as that of Example 1 and differs from the latter only in terms of the surface roughness and the pitch P of arrangement of the line grooves 1*a* having a triangular cross section of the amorphous silicon photosensitive drum 1. In this comparative example, the amorphous silicon photosensitive drum 1 shows an arithmetical mean deviation of the profile of Ra=0.05 to 0.07 μm, a ten-point height of irregularities of Rz=0.23 to 0.38 μm and a pitch P of arrangement of line grooves 1*a* of about 14 μm.

Comparative Example 2

The electrophotographic image forming apparatus used in this comparative example has substantially the same configuration as that of Example 1 and that of Comparative Example 1 and differs from the latter only in terms of the surface roughness and the pitch P of arrangement of the line grooves 1*a* having a triangular cross section of the amorphous silicon photosensitive drum 1. In this comparative example, the amorphous silicon photosensitive drum 1 shows an arithmetical mean deviation of the profile of Ra=0.13 to 0.15 μm, a ten-point height of irregularities of Rz=0.83 to 0.98 μm and a pitch P of arrangement of line grooves 1*a* of about 22 μm.

Comparative Example 3

The electrophotographic image forming apparatus used in this comparative example has substantially the same configuration as that of Example 1 and those of Comparative Examples 1and 2 and differs from the latter only in terms of the surface roughness and the pitch P of arrangement of the line grooves 1*a* having a triangular cross section of the amorphous silicon photosensitive drum 1. In this comparative example, the amorphous silicon photosensitive drum 1 shows an arithmetical mean deviation of the profile of Ra=0.33 to 0.36 μm, a ten-point height of irregularities of Rz=2.00 to 2.20 μm and a pitch P of arrangement of line grooves 1*a* of about 46 μm.

Now, the results of a durability text of producing 3,000,000 copies of the A4 size conducted in each of Examples 1 through 4 and Comparative Examples 1 through 3 will be summarily described below.

Figure 3:
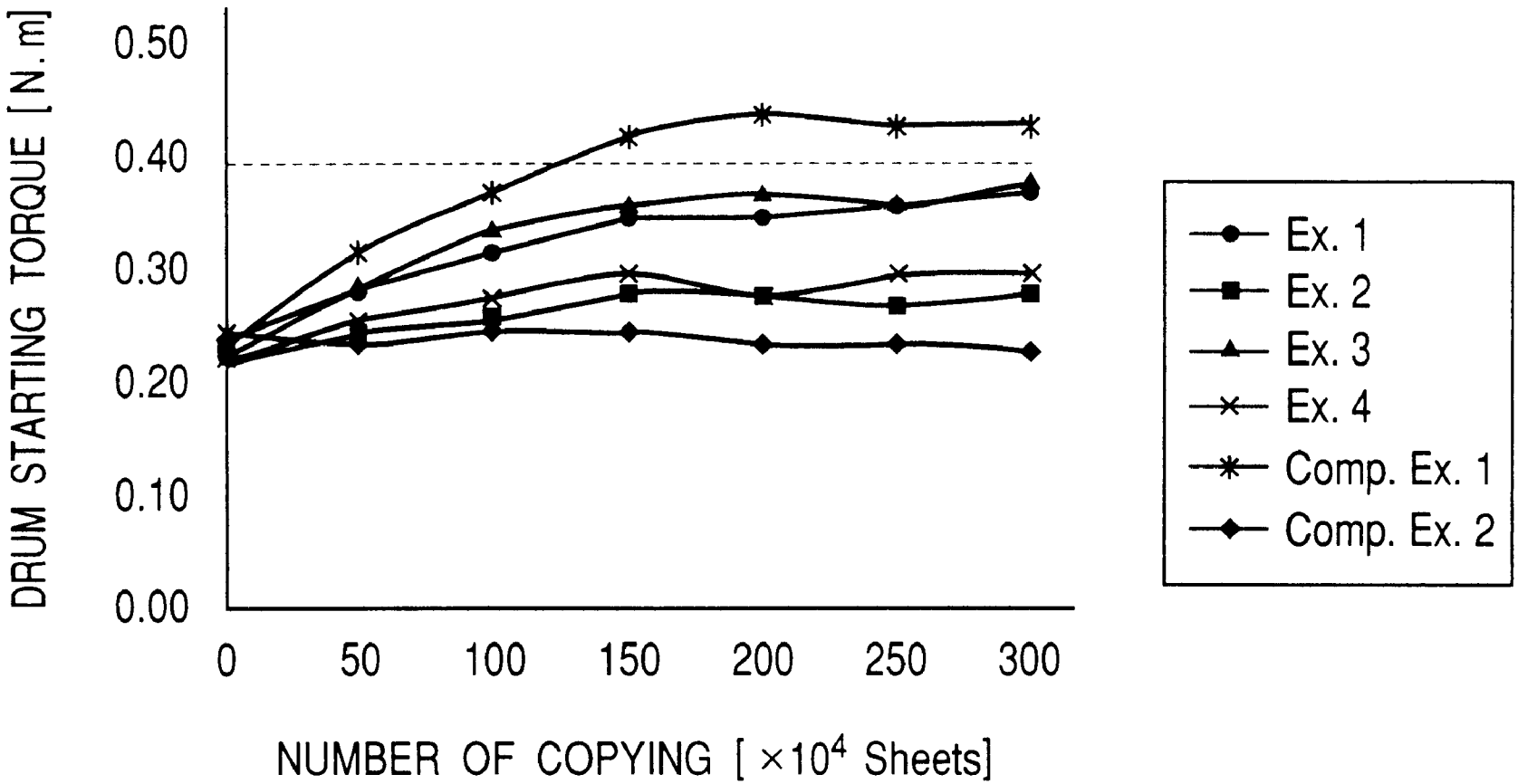
FIG. 3 is a graph illustrating the change in operation of the rotation starting torque of an amorphous silicon photosensitive drum as observed in different examples.

FIG. 3 is a graph illustrating the change in operation of the rotation starting torque of the amorphous silicon photosensitive drum as observed in Examples 1 through 4 and Comparative Examples 1 and 2. As clearly seen from FIG. 3, the rotation starting torque of the amorphous silicon photosensitive drum 1 of Comparative Example 1 exceeded 0.39 N·m when about 1,250,000 copies were made and molten toner became to adhere to the drum when about 1,300,000 copies were made. Furthermore, images that were unevenly drawn and/or showed streamy scars came to appear when about 1,700,000 copies were made. On the other hand, the rotation starting torque remained to be less than 0.39 N·m in the case of Examples 1 through 4, where the produced images were satisfactory and free from the problem of molten toner adhering to the drum and that of a scraped and damaged drum.

Figure 4:
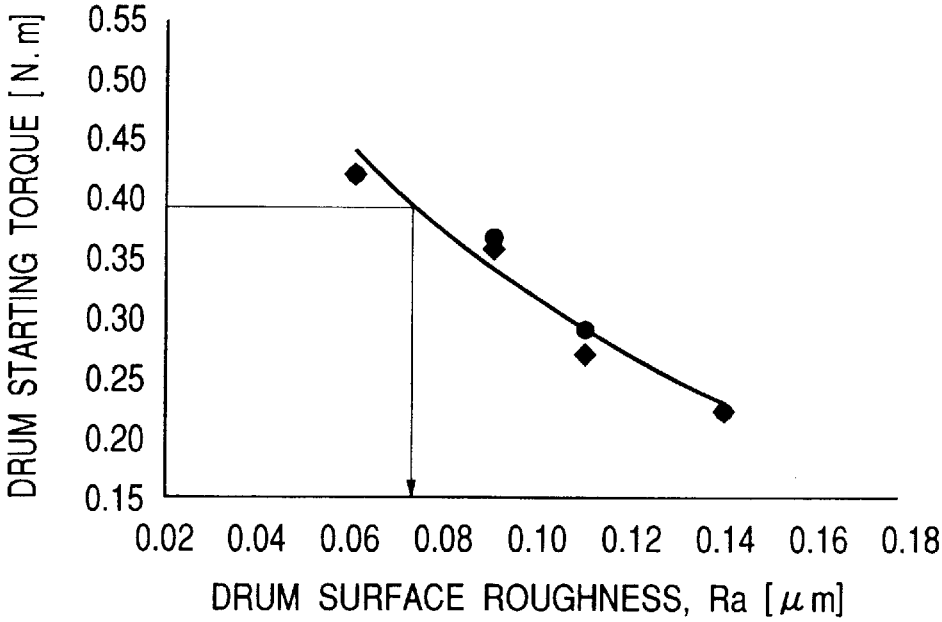
FIG. 4 is a graph illustrating the relationship between the rotation starting torque and the arithmetical mean deviation of the profile Ra of an amorphous silicon photosensitive drum.

FIG. 4 is a graph illustrating the relationship between the rotation starting torque and the arithmetical mean deviation of the profile Ra of the amorphous silicon photosensitive drum as observed in a durability test of producing 3,000,000 copies of the A4 size conducted in each of Examples 1 through 4 and Comparative Examples 1 and 2. Since the arithmetical mean deviation of the profile Ra shows dispersion of about 0.02 μm for each photosensitive drum, the center value of the dispersion is used for the graph. As clearly seen from the graph the rotation starting torque is inversely proportional to the arithmetical mean deviation of the profile Ra of the amorphous silicon photosensitive drum within the range of Ra=0.06 to 0.14 μm. From the approximate curve, it will be seen that the relationship of the rotation starting torque <0.39 N·m holds true when the arithmetical mean deviation of the profile Ra>0.074 μm.

Figure 5:
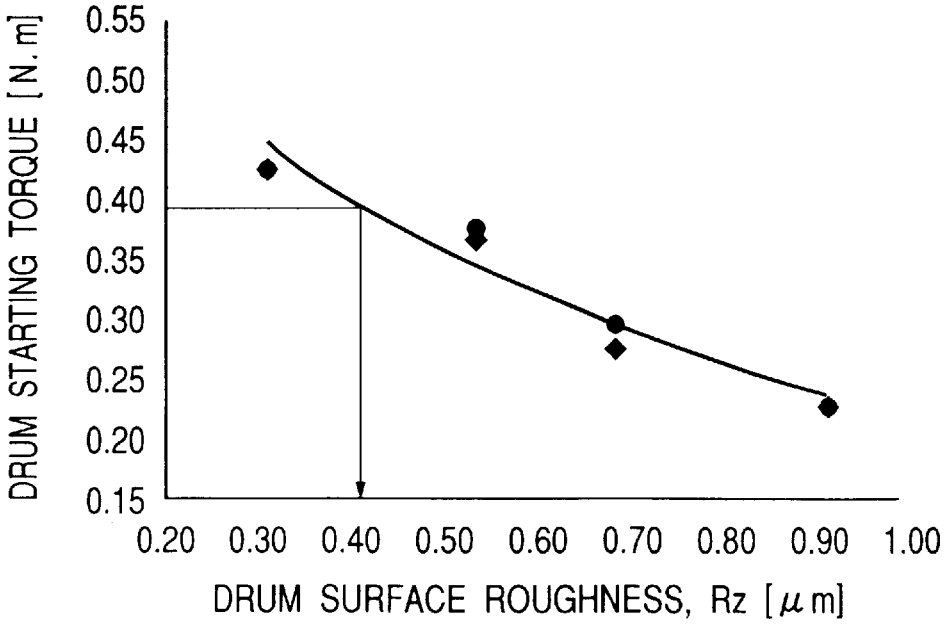
FIG. 5 is a graph illustrating the relationship between the rotation starting torque and the ten-point height of irregularities Rz of an amorphous silicon photosensitive drum.

FIG. 5 is a graph illustrating the relationship between the rotation starting torque and the ten-point height of irregularities Rz of the amorphous silicon photosensitive drum as observed in a durability test of producing 3,000,000 copies of the A4 size conducted in each of Examples 1 through 4 and Comparative Examples 1 and 2. Since the ten-point height of irregularities Rz shows dispersion of about 0.15 μm for each photosensitive drum, the center value of the dispersion is used for the graph. As clearly seen from the graph, the rotation starting torque is inversely proportional to the ten-point height of irregularities Rz of the amorphous silicon photosensitive drum within the range of Rz=0.30 to 0.90 μm. From the approximate curve, it will be seen that the relationship of the rotation starting torque <0.39 N·m holds true when the ten-point height of irregularities Rz>0.41 μm.

Taking the data shown in FIGS. 3 through 5 into consideration, it is necessary to make the relationship of the arithmetic mean deviation of the profile Ra>0.074 μm and that of the ten-point height of irregularities Rz>0.41 μm hold true in order to maintain the rotation starting torque <0.39 N·m, to prevent molten toner adhering to the drum, and for the produced images to be free from the problem of scars or unevenness attributable to a scraped and damaged drum.

Table 1 below summarily shows for comparison the level of unevenness of the produced images caused by the interference fringes of the laser beam to which the photosensitive drum is exposed in each of Examples 1 and 2 and Comparative Examples 1 through 3. For this comparison, solid images were outputted for a half tone range and a 3 stage rating system of A (no uneven images), B (slightly uneven images are found) and C (uneven images are prevalent) is used to evaluate the unevenness of each image.

TABLE 1

| | drum roughness Ra (μm) | drum roughness Rz (μm) | level of uneven image |
|---|---|---|---|
| Comparative Example 1 | 0.05–0.07 | 0.23–0.38 | A |
| Example 1 | 0.08–0.10 | 0.45–0.60 | A |
| Example 2 | 0.10–0.12 | 0.60–0.75 | A |
| Comparative Example 2 | 0.13–0.15 | 0.83–0.98 | B |
| Comparative Example 3 | 0.33–0.36 | 2.00–2.20 | C |

As clearly seen from Table 1, uneven images can hardly be produced when the surface roughness values of Ra and Rz of the drum are small. Ra and Rz need to be respectively less than 0.12 μm and 0.75 μm in order to obtain fine images that are free from any unevenness.

Therefore it is obvious by seeing FIGS. 3 through 5 and Table 1 that, in order to make the photosensitive drum free from the problem of molten developer adhering to the surface of the drum and produce good images that are free from the problem of unevenness and streamy scars due to a scraped drum and also free from the problem of unevenness attributable to interference fringes of light in the laser beam exposure, the surface roughness of the amorphous silicon photosensitive drum should be such that the arithmetic mean deviation of the profile Ra is greater than 0.074 μm but not greater than 0.12 μm and the ten-point height of irregularities Rz is greater than 0.41 μm but not greater than 0.75 μm and the rotation starting torque should be constantly held to not greater than 0.39 N·m. Taking the dispersed appearances of molten developer adhering to the drum, it is preferable that the arithmetic mean deviation of the profile Ra is 0.08 to 0.12 μm while the ten-point height of irregularities Rz is 0.45 to 0.75 μm.

While one-ingredient magnetic toner was used as developer in Examples 1 through 4, it may be replaced by two-ingredient toner or nonmagnetic toner. While the cleaning blade 9 was made of urethane rubber in each of the above Examples 1 through 4, it may alternatively be made of some other silicone rubber type material.

As described above in detail, according to the invention, it is therefore possible to provide an electrophotographic image forming apparatus that can durably form high quality images without the problem of uneven and/or distorted images and that of molten toner adhering to the drum surface and of a scraped drum and also an electrophotographic image forming method that can be used with such an electrophotographic image forming apparatus.

Additionally, according to the invention, it is also possible to provide an electrophotographic image forming apparatus that can suppress the rotation starting torque of the photosensitive drum and consequently make itself free from the problems of unevenly drawn images, molten toners adhering to the drum surface and a scraped drum after a long use so as to improve the image quality and the durability and also an electrophotographic image forming method that can be used with such an electrophotographic image forming apparatus.

Furthermore, according to the present invention, it is also possible to provide an electrophotographic image forming apparatus for which a cleaning means including a cleaning blade and a cleaning auxiliary member of a magnet roller for supplying toner to the photosensitive drum is used in order to further improve the durability of the apparatus and also an electrophotographic image forming method that can be used with such an electrophotographic image forming apparatus.

Finally, with an electrophotographic image forming apparatus according to the invention, the produced images are free from unevenness and molten toner is prevented from adhering to the photosensitive drum after long use. Additionally, the drum is prevented from being scraped, thereby allowing the electrophotographic image forming apparatus to durably produce high quality images, when a plurality of line grooves having a triangular cross section are formed on the surface of the base member of the photosensitive drum and arranged around the circumference in parallel with each other. The surface roughness of the photosensitive drum is such that the arithmetic mean deviation of the profile Ra is 0.08 to 0.12 $\mu$m and the ten-point height of irregularities Rz is 0.45 to 0.75 $\mu$m, while the rotation starting torque of the photosensitive drum is constantly held not greater than 0.39 N·m. The durability of the electrophotographic image forming apparatus can be further improved when the cleaning means includes a cleaning blade and a cleaning auxiliary member that is a magnet roller for supplying developer to the photosensitive drum and located upstream relative to the cleaning blade.

What is claimed is:

1. An electrophotographic image forming apparatus comprising:

a photosensitive drum;

an image exposure unit for drawing an electrostatic latent image on a surface of said photosensitive drum;

a developing unit for developing the electrostatic latent image on the surface of said photosensitive drum by means of developer;

a transfer charger for transferring the image developed by means of developer onto a receiving material; and a cleaning unit for removing developer remaining on the surface of said photosensitive drum after the transfer;

said photosensitive drum being driven to rotate so as to make a cycle of image forming operation proceed, wherein said photosensitive drum includes a base member on a surface of which a plurality of line grooves having a triangular cross section are formed and arranged around the circumference in parallel with each other at a pitch of 17 to 19 $\mu$m, and wherein said photosensitive drum has a photosensitive layer of amorphous silicon on the base member, said photosensitive layer having an arithmetical mean deviation of the profile of Ra=0.08 to 0.12 $\mu$m.

2. An electrophotographic image forming apparatus according to claim 1, wherein a ten-point height of irregularities of the surface of said photosensitive drum is Rz=0.45 to 0.75 $\mu$m.

3. An electrophotographic image forming apparatus according to claim 1 or 2, wherein said cleaning unit includes a cleaning blade and a cleaning auxiliary member.

4. An electrophotographic image forming apparatus according to claim 3, wherein said cleaning auxiliary member is a magnet roller for supplying developer to the photosensitive drum and is located upstream relative to the cleaning blade.

5. An electrophotographic image forming apparatus according to claim 1 or 2, wherein said photosensitive drum is driven with a rotation starting torque not greater than 0.39 N·m.

* * * * *